US006154942A

United States Patent [19]

Toeniskoetter

[11] Patent Number: 6,154,942

[45] **Date of Patent: *Dec. 5, 2000**

[54] CLOSURE PANEL HEMMING APPARATUS

[75] Inventor: James B. Toeniskoetter, Rochester Hills, Mich.

[73] Assignee: Tesco Engineering, Inc., Auburn Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,692

[22] Filed: Sep. 26, 1997

[51] Int. Cl.[7] ..... B23P 11/00

[52] U.S. Cl. ..... 29/243.58; 72/454; 72/456; 72/449

[58] Field of Search ..... 29/243.5, 465, 29/701, 283.5, 243.57, 33.5, 294, 511, 243.58; 72/456, 454, 449

[56] References Cited

U.S. PATENT DOCUMENTS

| | | | |
|---|---|---|---|
| 258,134 | 5/1882 | Schenck . | |
| 2,225,145 | 12/1940 | Baumbach . | |
| 2,730,981 | 1/1956 | Ernst . | |
| 2,852,062 | 9/1958 | Lorant . | |
| 2,983,159 | 5/1961 | Zeligowsky et al. . | |
| 3,010,432 | 11/1961 | Robra et al. . | |
| 3,190,215 | 6/1965 | Howard et al. . | |
| 3,198,108 | 8/1965 | Ingold . | |
| 3,422,658 | 1/1969 | Michelson . | |
| 3,450,037 | 6/1969 | Lickliter et al. . | |
| 3,673,849 | 7/1972 | Voitsekhousky et al. . | |
| 3,793,943 | 2/1974 | Olson . | |
| 3,861,192 | 1/1975 | Suzuki et al. . | |
| 4,557,156 | 12/1985 | Teramachi . | |
| 4,726,273 | 2/1988 | Miceli | 83/629 |
| 4,786,351 | 11/1988 | Elliott et al. | 29/91.1 X |
| 4,865,536 | 9/1989 | Inaba | 425/556 |
| 4,920,783 | 5/1990 | Greaves et al. . | |
| 5,086,638 | 2/1992 | David | 72/451 |
| 5,107,579 | 4/1992 | Kostermeier . | |
| 5,150,508 | 9/1992 | St. Denis | 29/463 |
| 5,454,261 | 10/1995 | Campian | 72/384 |
| 5,457,981 | 10/1995 | Brown | 72/451 |
| 5,466,207 | 11/1995 | Arens | 483/28 |
| 5,746,083 | 5/1998 | Kovarovic | 72/315 |
| 5,953,225 | 9/1999 | Larsen . | |

FOREIGN PATENT DOCUMENTS

| | | |
|---|---|---|
| 2067119 | 7/1981 | United Kingdom . |

*Primary Examiner*—David P. Bryant
*Assistant Examiner*—Steven Blount
*Attorney, Agent, or Firm*—Fildes & Outland, P.C.

[57] ABSTRACT

A closure panel hemming apparatus includes a lower support supporting a lower hemming die and an upper support spaced from and mounted above the lower support supporting an upper hemming die. The upper and lower supports are relatively vertically moveable for bringing the dies toward and away from one another. At least one guide post interconnects the upper and lower supports and maintains alignment of the upper and lower supports during movement thereof. A plurality of actuators of the ball screw or rack and pinion type is driveably connected to draw together the upper and lower supports bringing the dies together for edge hemming preformed metal panels nested between the dies.

20 Claims, 3 Drawing Sheets

CLOSURE PANEL HEMMING APPARATUS

FIELD OF THE INVENTION

This invention relates to hemming two preformed metal panels together to form a closure panel and more particularly to an improved hemming apparatus and method that does not require conventional press means for supporting the hemming dies.

BACKGROUND OF THE INVENTION

It is known in the automotive industry to join two metal preformed panels into a unitary hollow structural unit. Typical units of this type include vehicle doors, hoods, and trunk lids. Collectively, these units are referred to as closure panels.

A conventional process of joining the two panels together is referred to as hemming and results in a flange of the outer panel being folded over and gripping the edge of the inner panel. The process is well known. A conventional method and apparatus for joining two metal preformed panels is disclosed in U.S. Pat. No. 5,150,508 and its disclosure is incorporated herein by reference.

Conventional press style hemming machines require a tall press system having a base and platens on which upper and lower dies are mountable. The press system is actuated by a hydraulic cylinder having a limited stroke. Metal panels are nested together between the dies and the dies are moved toward each other to edge hem the two panels together. These conventional machines typically have a single hydraulic cylinder to drive the upper and lower dies, making it difficult to control pressing the corners of the panels together. Hydraulic fluid used in the hydraulic system is flammable.

These conventional hemming machines are costly and large requiring significant floor space and ceiling height. In addition, these machines require significant maintenance yet are difficult to maintain because of the limited stroke of the hydraulic cylinder which allows limited access between the upper and lower dies.

SUMMARY OF THE INVENTION

The present invention provides a hemming apparatus and method that eliminates the conventional press system.

The present invention also provides a hemming apparatus and method that improves control during edge hemming of two preformed panels.

In addition, the present invention provides a hemming apparatus and method that is less costly, eliminates the use of hydraulics and is easier to maintain.

More-specifically, the closure panel hemming apparatus comprises a lower support or platen, supporting a lower hemming die and an upper support, or platen spaced from and mounted above the lower support and supporting an upper hemming die. The upper and lower supports are relatively vertically moveable for bringing the dies toward and away from one another. Guide posts interconnect the upper and lower supports and maintain alignment of the upper and lower supports during movement thereof. A plurality of actuators each of the ball screw or rack and pinion type is driveably connected to draw together the upper and lower supports bringing the dies together for hemming.

In one embodiment each actuator is a ball screw actuator including a ball screw mounted on the lower support and a ball nut mounted on the upper support. A drive motor is provided for driving the ball screw. A controller electrically connected to the drive motor controls motor operation.

Preferably the closure panel hemming apparatus includes a plurality of guide posts and ball screw actuators. The closure panel hemming apparatus can include synchronous drive means for driving the plurality of actuators from the drive motor. Spring units associated with ball screw actuators assure an even application of force by the actuator limited to a preset level. Alternatively, the closure panel hemming apparatus can include a plurality of drive motors corresponding to the number of ball screw actuators wherein each ball screw actuator is independently driven.

In another embodiment each actuator is a rack and pinion actuator including a rack mounted on a guide post otherwise fixed relative to one of the supports. A pinion fixedly mounted relative to the other support is driven by a drive motor to cause relative movement between upper and lower supports. A controller electrically connected to the drive motor controls motor operation.

In either embodiment, the upper support and upper die as well as the lower support and lower die can be of integral construction.

A method for forming a vehicle closure panel assembly from outer and inner metal panels, includes the steps of:

supporting the lower hemming die on the lower support;

supporting the upper hemming die on the upper support;

disposing preformed metal panels between the lower and upper hemming dies;

maintaining alignment of the upper and lower dies during relative movement thereof by means of guide posts extending between the supports; and drawing the dies together, through the operation of a plurality of actuators drawing together the supports, to hem the metal panels.

These and other features and advantages of the invention will be more fully understood from the following detailed description of the invention taken together with the accompanying drawings.

DETAILED DESCRIPTION OF THE INVENTION

Figure 1:
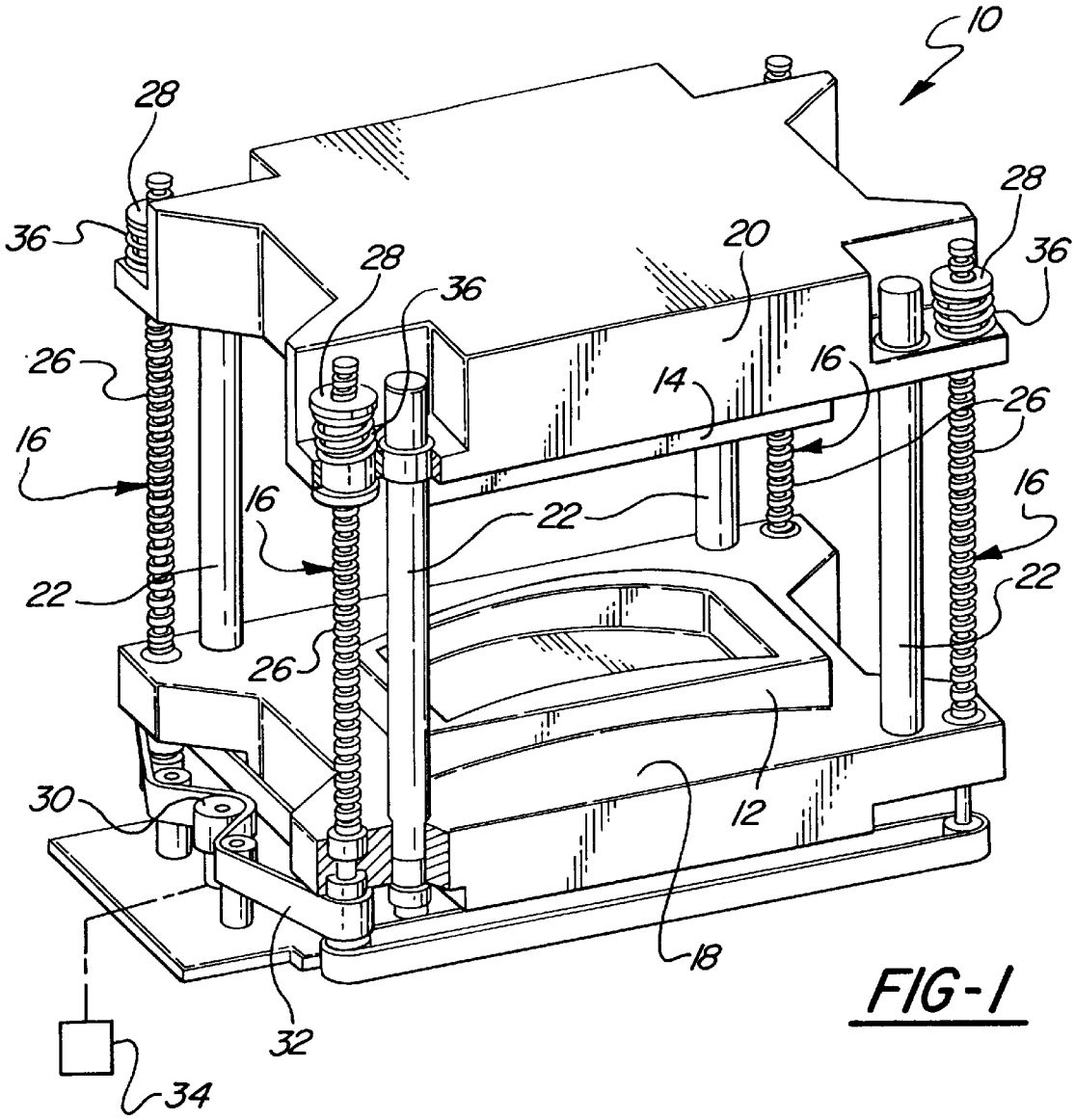
FIG. 1 is a schematic perspective view of a hemming apparatus constructed in accordance with a ball screw actuator embodiment of the present invention.

Referring now to the drawings in detail, numerals 10,110 generally indicates hemming apparatus including lower and upper dies 12,14. Dies 12,14 are mounted and moveable relative to each other by ball screw or rack and pinion actuators 16,116,216 for edge hemming the periphery of nested metal panels together to form a unitary closure panel such as a vehicle door, hood or trunk lid. As is hereinafter more fully described, hemming apparatus 10,110,210 are generally self contained machines that eliminate the conventional press for supporting and actuating the movement of the hemming dies.

As illustrated in FIG. 1 the closure panel hemming apparatus 10 includes a lower support 18 on which the lower die 12 is supported. An upper support 20 is spaced from and mounted above the lower support 18. Upper die 14 is supported on upper support 20. Alternatively, the upper support 20 and upper die 14 are integral as are the lower support 18 and lower die 12.

The upper and lower supports 18,20 are relatively vertically moveable for bringing the dies 12,14 toward and away from one another to perform hemming of preformed metal panels nested between the dies.

Figure 2:
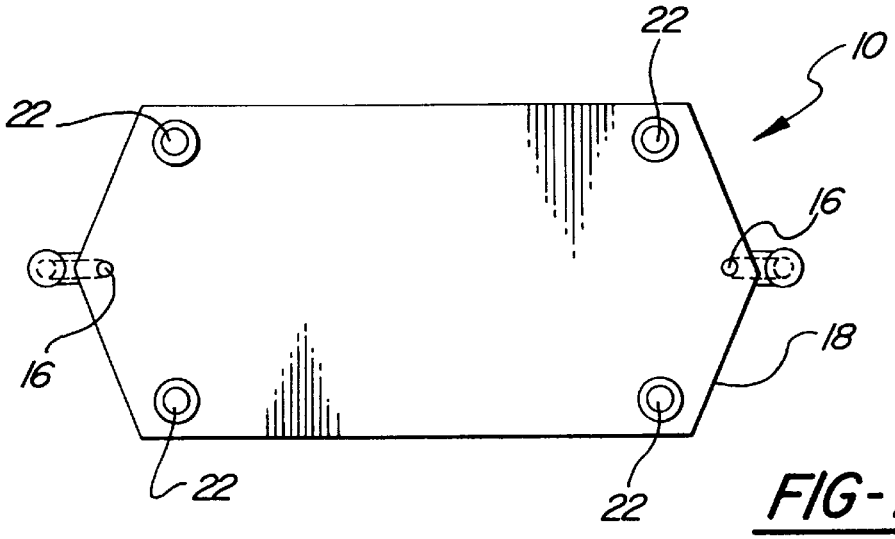
FIG. 2 is a schematic plan view of a hemming apparatus constructed in accordance with the invention illustrating an alternative arrangement of guide posts and actuators.

As shown in FIG. 1, four guide posts 22, located at the corners of the apparatus 10, interconnect the upper and lower supports 20,18 and maintain alignment of the upper and lower supports during the relative vertical movement. Four ball screw actuators 16, located adjacent the guide posts 22, are driveably connected to the lower and upper supports 18,20 to cause relative movement of the upper and lower supports thereby generating relative movement of the dies 12,14. According to the invention, ball screw actuators 16 draw together lower and upper supports 18,20 during the hemming of preformed metal panels to accurately control the hemming process. Other arrangements of actuators 16 and guide posts 22 can be used such as two actuators 16 and four guide posts 22 as schematically illustrated in FIG. 2. Accordingly, the need for a press into which upper and lower dies are mounted is eliminated, reducing floor space and cost required to perform a hemming operation.

With continued reference to FIG. 1, each ball screw actuator 16 includes a ball screw 26 mounted on the lower support 18 and a ball nut 28 mounted on the upper support 20. In the embodiment illustrated, a single drive motor 30 drives the ball screw actuators 16 through a drive means 32, herein illustrated as an endless drive belt, although other known endless drive means and gear drives can be used. Preferably drive motor 30 is a synchronous drive motor. A controller 34 is electrically connected to the drive motor 30 controlling motor operation and the controlled application of drawing force upon die closing. Limit switches, such as a compression limit switch and an over travel limit switch, can be used to back up the controller 34 and as a safety feature.

Optional spring units 36, including known spring types such as wire, gas, or marshmallow springs can be associated with the ball nuts 28 to assure an even application of force by the actuators 16 limited to a preset level.

Figure 3:
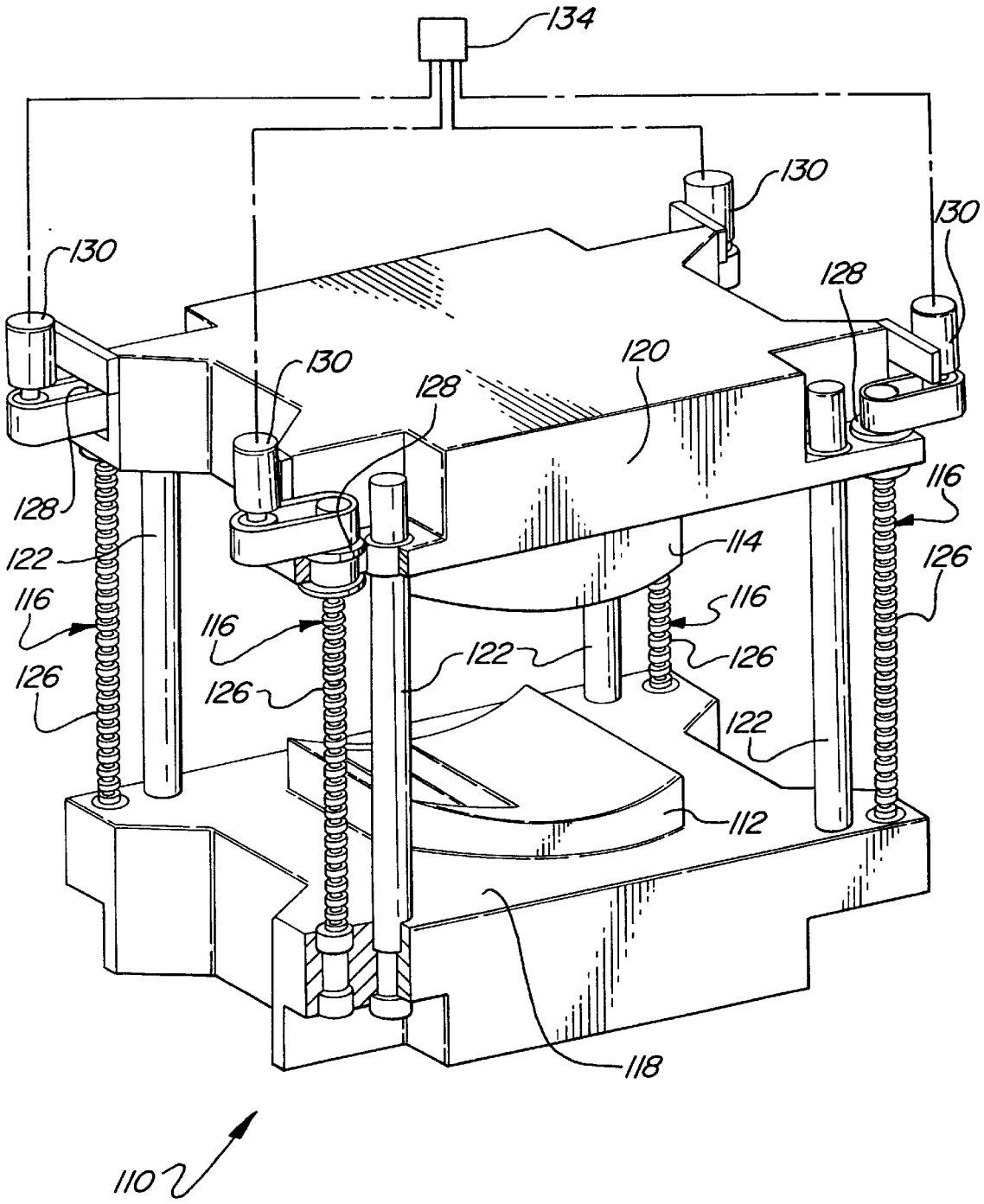
FIG. 3 is a schematic perspective view of a hemming apparatus constructed in accordance with the ball screw actuator embodiment of the present invention illustrating an alternative ball screw drive arrangement.

In an alternative arrangement of hemming apparatus 110 illustrated in FIG. 3, each ball screw actuator 116 is driven by a drive motor 130 and these drive motors are controlled by the controller 134 to assure an equal application of drawing force during the bringing together of the dies 112,114 during hemming.

Figure 4:
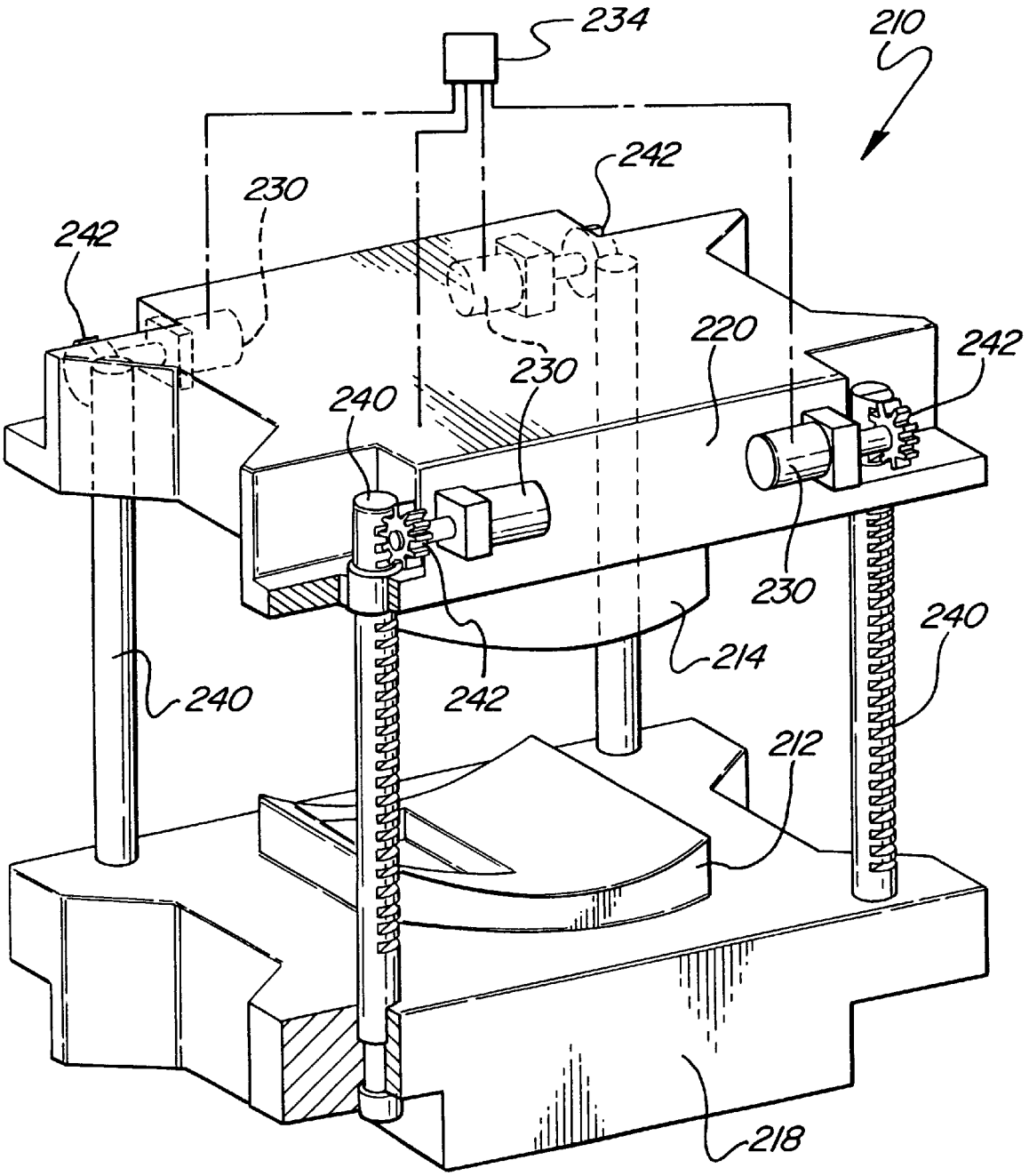
FIG. 4 is a schematic perspective view of a hemming apparatus constructed in accordance with a rack and pinion actuator embodiment of the present invention.

FIG. 4 illustrates another embodiment of the invention wherein like reference characters refer to like structure previously described. In FIG. 4, the hemming apparatus 210 includes rack and pinion actuators 216. Four guide posts 222 are provided for interconnecting the upper and lower supports 220,218 and maintaining alignment of the upper and lower supports during movement thereof. On the side of each guide post 222 a rack 240 is provided. In the arrangement shown, the posts 222 are generally round in cross section, although the post can be of rectangular as well as other geometrical cross sectional shapes, and the upper end 242 of the guide posts 222 are fixed to the upper support 220. Pinions 242 on drive motors 230 drive the racks 240 on the guide posts 222 to move the upper and lower supports 220,218 toward and away from one another. As with the ball screw embodiments of the invention, the supports are drawn together by means extending between the supports and hemming apparatus 210 can be assembled in a variety of configurations. For example, rack 240 and guide post 222 can be independent and there can be more guide posts than actuators. Alternatively, one end of the rack can be fixedly mounted on the lower support and the pinion drives can be mounted relative to the upper support.

By way of example, the operation of hemming apparatus 10,110,210 is herein described with reference to the ball screw actuated hemming apparatus 10. Vehicle closure panel are formed from outer and inner preformed metal panels by, supporting the lower hemming die 12 on the lower support 18 and supporting the upper hemming die 14 on the upper support 20. Preformed metal panels are disposed between the lower and upper hemming dies 12,14. Alignment of the lower and upper dies 12,14 during relative movement is maintained by means of guide posts 22 extending between the supports 18,20. The dies are drawn together, through the operation of a plurality of actuators drawing together the supports, to hem the nested metal panels.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A closure panel hemming apparatus comprising:

a lower platen for mounting a lower hemming die;

an upper platen for mounting an upper hemming die;

said upper platen being disposed above said lower platen;

at least one vertically extending guide post interconnecting and disposed between said lower and upper platens and maintaining alignment of said platens during relative movement; and a plurality of linear drawing members connecting and extending in between said lower and upper platens and constituting the sole means operative to draw together said platens, said drawing members being fixed against vertical motion relative to one of said platens and vertically movable relative to the other of said platens.

2. The closure panel hemming apparatus of claim 1 wherein said linear drawing members comprise at least one of ball screw and rack and pinion actuators.

3. The closure panel hemming apparatus of claim 2 wherein said actuator is a ball screw actuator.

4. The closure panel hemming apparatus of claim 3 wherein said ball screw actuator includes a ball screw mounted on said lower platen and a ball nut mounted on said upper platen.

5. The closure panel hemming apparatus of claim 4 including a drive motor for driving one of said ball screw and said ball nut.

6. The closure panel hemming apparatus of claim 5 including a controller electrically connected to said drive motor for controlling motor operation.

7. The closure panel hemming apparatus of claim 6 including a plurality of guide posts and ball screw actuators.

8. The closure panel hemming apparatus of claim 7 including synchronous drive means for driving said plurality of actuators from said drive motor.

9. The closure panel hemming apparatus of claim 7 including a plurality of said drive motors corresponding to the number of said ball screw actuators.

10. The closure panel hemming apparatus of claim 7 including spring units associated with said ball nuts for assuring an even application of force by said actuators limited to a preset level controlled by said spring units.

11. The closure panel hemming apparatus of claim 2 wherein said actuator is a rack and pinion actuator.

12. The closure panel hemming apparatus of claim 11 wherein said rack and pinion actuator includes a rack fixedly mounted on said one of said platens and a pinion mounted relative to the other of said platens.

13. The closure panel hemming apparatus of claim 12 wherein said rack is disposed on said guide post.

14. The closure panel hemming apparatus of claim 13 wherein said guide post is fixedly mounted on said lower support.

15. The closure panel hemming apparatus of claim 14 wherein said pinion is mounted to said upper platen.

16. A closure panel hemming apparatus comprising:

a lower support of a generally planar shape;

a lower hemming die supported by said lower support;

an upper support of a generally planar shape spaced from and disposed completely above said lower support;

said lower support being disposed completely below said upper support;

an upper hemming die supported by said upper support;

said upper and lower supports being relatively vertically movable for bringing said dies toward and away from one another;

at least one vertically extending guide post interconnecting and disposed perpendicularly between said upper and lower supports and maintaining alignment of said supports during movement thereof; and a plurality of actuators each comprising at least one of ball screw and rack and pinion actuators connected to and extending perpendicularly in between said lower and said upper supports and constituting the sole means operative to draw together said supports, bringing said dies together for hemming, said actuators being fixed against vertical motion relative to one of said supports and vertically movable relative to the other of said supports.

17. The closure panel hemming apparatus of claim 16 wherein said upper hemming die is integral with said upper support.

18. The closure panel hemming apparatus of claim 16 wherein said lower hemming die is integral with said lower support.

19. The closure panel hemming apparatus of claim 16 wherein said upper hemming die is integral with said upper support.

20. The closure panel hemming apparatus of claim 16 wherein said lower hemming die is integral with said lower support.

* * * * *